US010711667B2

(12) United States Patent
Tavernier

(10) Patent No.: US 10,711,667 B2
(45) Date of Patent: Jul. 14, 2020

(54) INTERNAL COMBUSTION ENGINE WITH TUBULAR VALVES AND BRAKING SYSTEM

(71) Applicant: Jonathan Tavernier, Strasburg, VA (US)

(72) Inventor: Jonathan Tavernier, Strasburg, VA (US)

( * ) Notice: Subject to any disclaimer, the term of this patent is extended or adjusted under 35 U.S.C. 154(b) by 171 days.

(21) Appl. No.: 15/884,610

(22) Filed: Jan. 31, 2018

(65) Prior Publication Data

US 2019/0234254 A1 Aug. 1, 2019

(51) Int. Cl.

| | |
|---|---|
| ***F01L 7/02*** | (2006.01) |
| ***F01L 13/06*** | (2006.01) |
| ***F01M 9/10*** | (2006.01) |
| ***F01L 1/02*** | (2006.01) |
| ***F01L 7/16*** | (2006.01) |
| *F01L 1/053* | (2006.01) |

(52) U.S. Cl.

CPC ..... *F01L 13/065* (2013.01); *F01L 1/026* (2013.01); *F01L 7/026* (2013.01); *F01L 7/16* (2013.01); *F01L 13/06* (2013.01); *F01M 9/109* (2013.01); *F01L 2001/0537* (2013.01); *F01L 2101/00* (2013.01); *F01L 2250/02* (2013.01); *F01L 2250/04* (2013.01); *F01L 2250/06* (2013.01); *F01L 2800/08* (2013.01); *F01L 2810/02* (2013.01); *F01L 2820/01* (2013.01)

(58) Field of Classification Search

CPC ..... F01L 13/065; F01L 1/026; F01L 7/026; F01L 7/16; F01L 2101/00; F01L 7/027; F01M 9/109

See application file for complete search history.

(56) References Cited

U.S. PATENT DOCUMENTS

| | | | | |
|---|---|---|---|---|
| 1,094,329 A * | 4/1914 | Henderson | F01L 7/022 | 123/80 BA |
| 1,191,684 A * | 7/1916 | Fountain | F01L 7/022 | 123/80 BA |
| 1,215,993 A * | 2/1917 | Rimbach | F01L 7/022 | 123/80 BA |
| 1,596,069 A * | 8/1926 | Skiles | F01L 7/026 | 123/80 BA |
| 1,790,534 A | 1/1931 | Chevallier et al. | | |
| 1,794,061 A * | 2/1931 | Culver | F01L 7/026 | 123/190.2 |
| 2,401,932 A * | 6/1946 | Heintz | F01L 5/06 | 123/80 C |
| 2,730,088 A * | 1/1956 | Hyde | F01L 7/026 | 123/59.1 |
| 2,766,584 A | 10/1956 | Stockinger | | |
| 3,993,036 A * | 11/1976 | Tischler | F01L 7/026 | 123/190.2 |
| 4,007,725 A * | 2/1977 | Weaver | F01L 7/026 | 123/190.2 |

(Continued)

*Primary Examiner* — Thomas N Moulis
(74) *Attorney, Agent, or Firm* — Robert Goozner

(57) ABSTRACT

A tubular roller valve for an internal combustion engine, which includes a hollow tube having at least one hole, the at least one hole being configured to access an air inlet or an exhaust of a cylinder in an engine block, a tubular outer insulator outside of the hollow tube, the outer insulator being fixed to a cylinder head, and a tubular inner insulator inside of the hollow tube. An additional tube between the hollow tube and the outer insulator can serve to operate as a compression release brake.

20 Claims, 14 Drawing Sheets

(56) References Cited

U.S. PATENT DOCUMENTS 4,077,382 A * 3/1978 Gentile ..... F01L 7/026 123/190.1
4,333,427 A * 6/1982 Burillo ..... F01L 7/026 123/190.17
4,381,737 A * 5/1983 Turner ..... F01P 3/14 123/190.2
4,481,917 A * 11/1984 Rus ..... F01L 7/045 123/190.12
4,556,023 A * 12/1985 Giocastro ..... F01L 7/026 123/190.12
4,949,685 A * 8/1990 Doland ..... F01L 7/026 123/190.2
5,095,870 A * 3/1992 Place ..... F01L 7/022 123/190.4
5,309,876 A * 5/1994 Schiattino ..... F01L 1/34 123/190.2
5,372,104 A * 12/1994 Griffin ..... F01L 7/026 123/190.17
5,410,996 A * 5/1995 Baird ..... F01L 7/026 123/190.2
5,572,967 A * 11/1996 Donaldson, Jr. ..... F01L 1/344 123/190.12
5,579,730 A * 12/1996 Trotter ..... F01L 7/026 123/190.17
5,690,069 A * 11/1997 Huwarts ..... F01L 7/026 123/190.12
5,706,775 A * 1/1998 Schweter ..... F01L 7/021 123/190.12
5,711,265 A * 1/1998 Duve ..... F01L 7/10 123/190.1
6,443,110 B2 * 9/2002 Qattan ..... F01L 7/026 123/190.2
6,595,177 B1 * 7/2003 Kramar ..... F01L 7/02 123/190.2
6,691,664 B2 * 2/2004 Pisano ..... F01L 1/34406 123/190.17
7,140,342 B1 * 11/2006 Murray ..... F01L 7/026 123/190.1
7,255,082 B2 * 8/2007 Zajac ..... F01B 31/14 123/190.12
7,650,869 B2 * 1/2010 Slemp ..... F01L 1/022 123/190.17
8,616,171 B2 * 12/2013 Kiani ..... F01L 7/026 123/190.1
1,125,663 A1 1/2015 Crayssac
9,115,606 B2 8/2015 Vaseleniuck et al.
9,903,238 B2 * 2/2018 Tolbert ..... F01L 7/023
9,903,239 B2 * 2/2018 Vaseleniuck ..... F01L 7/026
10,094,303 B2 * 10/2018 Trentham ..... F02D 15/04
2001/0029918 A1 * 10/2001 Qattan ..... F01L 7/026 123/190.1
2002/0139342 A1 * 10/2002 Trentham ..... F01L 7/026 123/190.8
2006/0086335 A1 * 4/2006 Boulton ..... F01L 1/34 123/190.4
2006/0254554 A1 * 11/2006 Zajac ..... F01B 31/14 123/190.12
2007/0289562 A1 * 12/2007 Zajac ..... F02B 41/02 123/51 R
2009/0194058 A1 * 8/2009 Pascale ..... F01L 7/026 123/190.12
2016/0222839 A1 * 8/2016 Vaseleniuck ..... F01L 7/16
2016/0222840 A1 * 8/2016 Vaseleniuck ..... F16K 3/24
2016/0230617 A1 * 8/2016 Tolbert ..... F01L 7/023
2017/0226903 A1 * 8/2017 Tonsing ..... F01L 7/026
2018/0320630 A1 * 11/2018 Xia ..... F02F 1/243

* cited by examiner

INTERNAL COMBUSTION ENGINE WITH TUBULAR VALVES AND BRAKING SYSTEM

BACKGROUND OF THE INVENTION

Field of the Invention

An internal combustion engine, in particular an arrangement of valves for permitting air to enter a cylinder and exhaust gases to exit the cylinder, and can also act as a compression brake. In accordance with the invention, the valves take the form of a hollow tube having at least one hole, the hollow tube being sandwiched by insulators.

Description of the Related Art

FIG. 1 shows a diagram of an internal combustion engine of the conventional art. This conventional engine includes a crankshaft C, an exhaust camshaft E, an inlet camshaft I, a piston P, a connecting rod R, a spark plug S, inlet and exhaust valves V, and cooling water W.

During intake, the intake valves are open as a result of the cam lobe pressing down on the valve stem. The piston moves downward increasing the volume of the combustion chamber and allowing air to enter in the case of a CI (compression ignited or diesel) engine or an air fuel mix in the case of SI (spark ignition) engines that do not use direct injection. The air or air-fuel mixture is called the charge in any case.

During exhaust, the exhaust valve remains open, while the piston moves upward expelling the combustion gases. For naturally aspirated engines, a small part of the combustion gases may remain in the cylinder during normal operation because the piston does not close the combustion chamber completely; these gases dissolve in the next charge. At the end of this stroke of the piston, the exhaust valve closes, the intake valve opens, and the sequence repeats in the next cycle. The intake valve may open before the exhaust valve closes to allow better scavenging.

In the conventional art, the valves are commonly embodied as mushroom or poppet valves, formed of a stem and a tapered plug on one end of the stem, the stem being fitted to seal a hole in the cylinder in a closed position. A spring normally exerts a force against the stem to hold the plug against a seat of the hole, whereas a mechanical force exerted upon the step against the influence of the spring causes the plug to separate from the seat, causing the valve to open and permit gases to pass by the plug and through the hole. The mechanical force is often provided by a camshaft, rotation of which forces the valve open or permits the valve to close depending on the timing required of the valve.

Many disadvantages arise from the conventional poppet valves. These valves of a conventional drive train require springs, rockers and a camshaft for operation. These disparate parts are expensive to manufacture, require lubrication and cooling mechanisms, and frequently require maintenance. Also, the movement of these number of parts draw energy from the engine, which detracts from the useful horsepower output of the engine.

In addition, the timing of the opening and closing of poppet valves is normally strictly dictated by the structure of the cam shaft. Although recent innovations in this mechanism have resulted in some limited variations in the timing of such valve openings and closings in operation, such mechanisms remain complex and expensive, at least partly as a consequence of the underlying mechanics of poppet valves.

As a result, there is a need for a valve system for an internal combustion engine that alleviates the disadvantages of valve systems of the conventional art.

SUMMARY OF THE INVENTION

A valve system for an internal combustion engine includes a hollow tube, at least one hole in the hollow tube, the at least one hole being configured to access an air inlet or an exhaust port of a cylinder of an engine block, a tubular outer insulator outside of the hollow tube, the outer insulator being fixed to a cylinder head of the engine, and the hollow tube being positioned inside the outer insulator to rotate about a center axis running along a lengthwise direction of the hollow tube, and a tubular inner insulator inside of the hollow tube. The outer insulator, the hollow tube, and the inner insulator are concentric with one another about a common center axis.

In a preferred embodiment, an additional tube may be provided concentrically between the hollow tube and the outer insulator, with one or more holes along its periphery and located in positions complementary to the at least one hole of the hollow tube. The additional tube is configured to rotate independently of the hollow tube into predetermined positions. In a particularly preferred embodiment, independent rotational motion of the additional tube may close access of the at least one hole of the hollow tube to the exhaust port of the cylinder, and thereby cause the engine to experience compression release engine braking.

The hollow tube is smooth bore and rotates between the outer insulator and the inner insulator. Air and exhaust flow through the hollow tube as it rotates, and exhaust exits out the back end of the engine. The invention uses no poppet valves, rockers or camshaft.

The outer insulator has a hole or opening corresponding to each cylinder in the engine block, and the inner insulator has a hole corresponding to each cylinder in the engine block. The outer insulator has a hole corresponding to each cylinder in the engine block, and each hole in the outer insulator is associated with a lubrication port. A timing gear can be at one end of the outer tube. A clearance between the hollow tube and each of the outer insulator and the inner insulator is between 0.001 inches and 0.003 inches.

A particular embodiment of the present invention pertains to an exhaust valve and a compression release engine brake mechanism (also known as an engine brake or "Jake brake") for a four stroke internal combustion engine This embodiment includes a hollow tube, at least one hole in the hollow tube, the at least one hole being configured to access an air inlet or an exhaust of a cylinder in an engine block, a tubular outer insulator outside of the hollow tube, the outer insulator being fixed to a cylinder head, a tubular inner insulator inside of the hollow tube, and a tubular brake between the hollow tube and the outer insulator, the tubular brake having several combinations of louvers configured for compression release engine braking a corresponding combination of engine cylinders. A timing gear can be connected to the hollow tube. A brake clutch is configured to rotate the tubular brake, and a solenoid is provided for activating the brake clutch. The compression release engine brake can include an engine brake pressure plate. Position cleats may be connected to the tubular brake.

It is to be understood that both the foregoing general description and the following detailed description are exemplary and explanatory and are intended to provide further explanation of the invention as claimed.

BRIEF DESCRIPTION OF THE DRAWING FIGURES

The accompanying drawings are included to provide a further understanding of the invention. The drawings illustrate embodiments of the invention and together with the description serve to explain the principles of the embodiments of the invention.

DETAILED DESCRIPTION OF THE INVENTION

Figure 1:
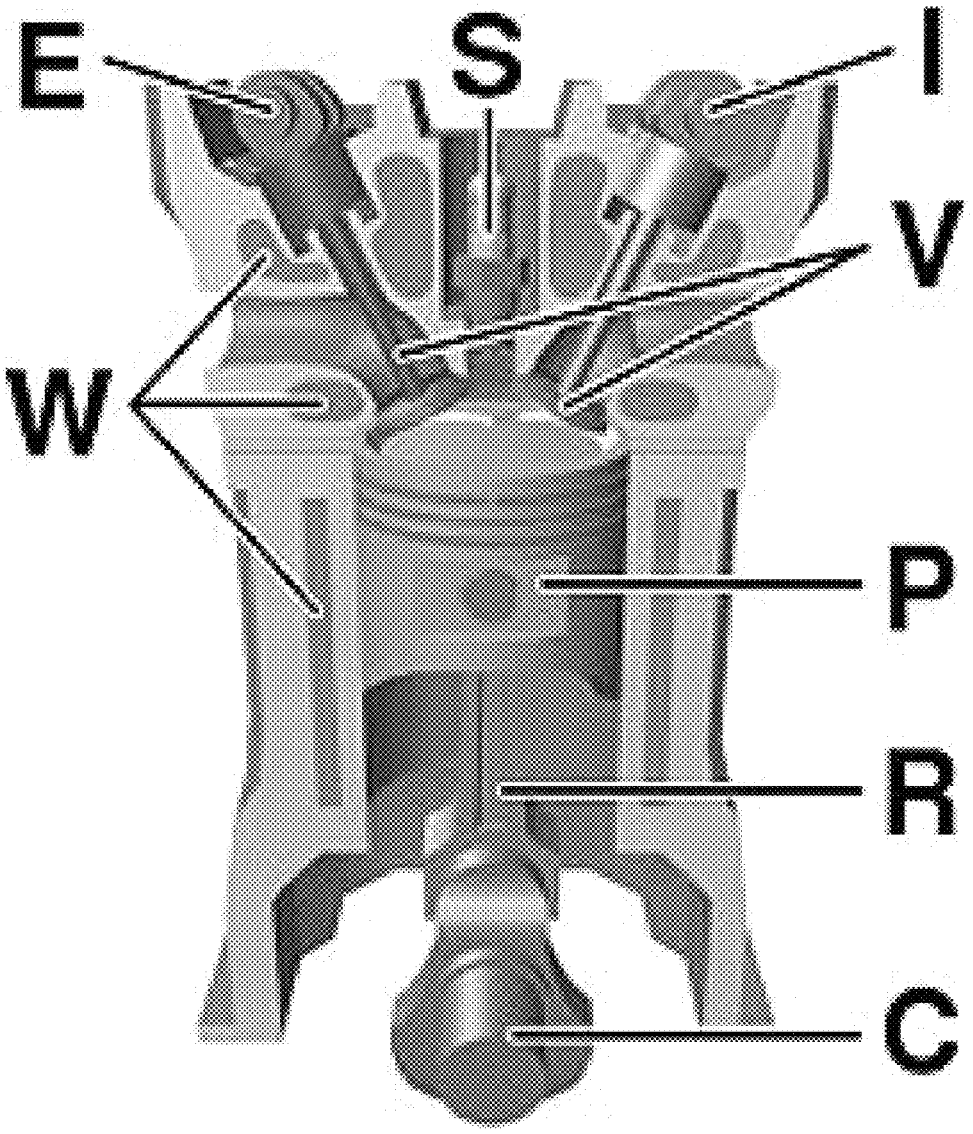
FIG. 1 shows an internal combustion engine of the conventional art.

Advantages of the present invention will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The engine of the present invention includes a cylinder or engine head with specially designed air intake and exhaust valves formed from a series of hollow tubes, configured to rotate along their respective lengthwise axes, thereby forming smooth bore roller valves. The roller valves are equipped with portholes, two such portholes for each cylinder per roller, depending upon the engine size.

As the engine piston retreats from the engine head during the intake stroke, the rollers valves spin, exposing the air intake port so the piston can draw air into the cylinder. As the piston returns toward the engine head during the compression stroke, the roller valves rotate to a position that closes the air intake port, trapping the air in the cylinder so that the piston can compress the air in the combustion chamber. Fuel injected into the cylinder mixes with the air and ignites, and the expanding gases resulting from ignition force the piston downward in the power stroke. As the piston travels from top dead center to bottom dead center in this stroke, the exhaust roller valve spins to expose its exhaust port so the piston can force out the exhaust gases in the subsequent exhaust stroke.

The fundamental source of the engine design of the invention is in the heads. The roller valves are fabricated from the cylinder ports, smooth bore for sustaining compression. The roller valves are fitted with concentric insulator tubes, one on the inside and one on the outside of the each roller valve. The roller valve bore is snugged in between the tube to maintain compression while the roller valve spins inside the insulator tubes.

Regarding lubrication, as the roller valve spins inside the insulator tubes, the roller valves convey lubricating fluids such as engine oil through oil jacket ports running alongside the outer insulator tube. The oil goes through the outer tube and reaches contact with the roller valve, which conveys the oil to lubricate the inner or the outer tube and the outer of the inner insulator tube.

There are many advantages to the invention. Since the engine valves are formed from rollers, this engine uses no camshaft and no push rods. Power for rotating the rollers is provided by a mechanical link to the crankshaft, whereas the timing for opening and closing the ports provided by the roller valves takes place according to gear sprockets, belts, and/or chains that mechanically connect the roller valve with the crankshaft. The result is superior performance with less weight and complexity.

For example, as a consequence of the use of smooth roller valves as set forth herein, less torque is required from the crankshaft to operate the valves that regulate intake and exhaust, resulting in more useful output power from the engine, more fuel efficiency, less vibration and lower maintenance over conventional engines.

Figure 2:
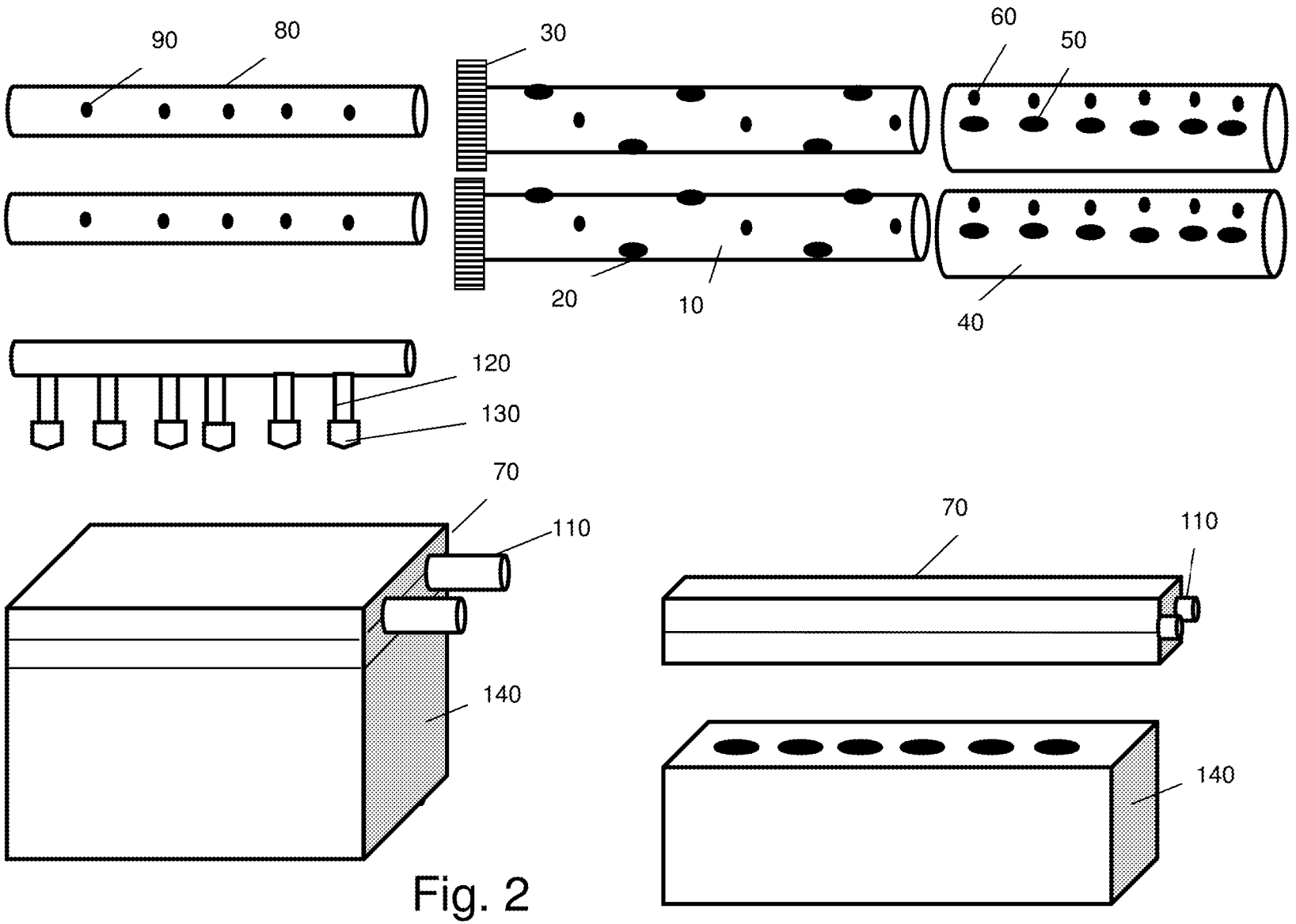
FIG. 2 shows an engine with a valve assembly according to an embodiment of the present invention.
Figure 3:
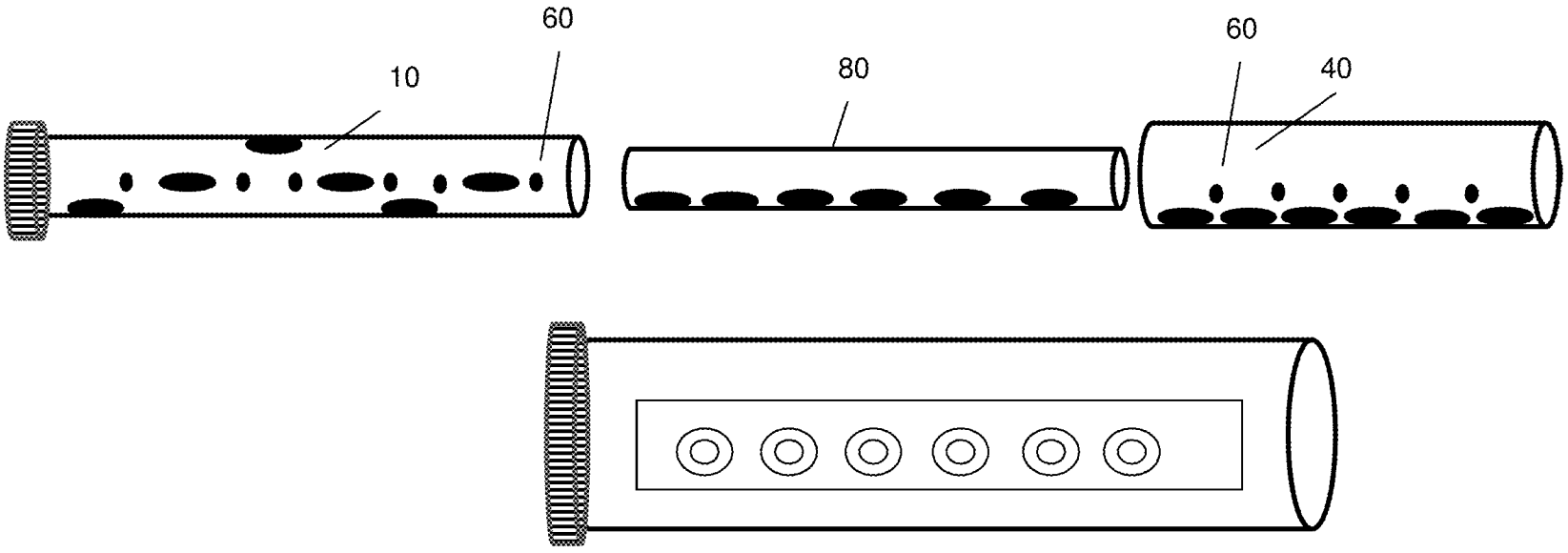
FIG. 3 shows details of the rotary valve of an embodiment of the present invention.

As is shown in FIGS. 2 and 3, a roller valve 10 is a hollow cylinder with a plurality of ports or holes 20 along its circumferential surface, normally one such hole per cylinder of the internal combustion engine. A timing gear 30 is attached to one end of the roller valve for driving the roller valve 10 in rotation. Surrounding the roller valve 10 is an outer insulator (also called a lubrication jacket), which is a hollow tube with a diameter greater than the roller valve 10, and has openings 50 that correspond to each cylinder of the internal combustion engine. At least one lubrication port 60 is associated with each opening 50 of the outer insulator 40. The outer insulator 40 is fixed in the cylinder head 70.

Inside the roller valve 10 is an inner insulator 80. The inner insulator 80 is a hollow tube with an outer diameter which is smaller than the inner diameter of the roller valve 10. The inner insulator has holes 90 which correspond to the holes in the roller valve.

The roller valve 10, the outer insulator 40 and the inner insulator 80 form a valve assembly 110. Two valve assemblies 110 can be mounted to the cylinder head 70. In a particular, but non-limiting embodiment, one roller valve assembly is used for air intake and the other valve assembly is used for exhaust.

In the non-limiting embodiment shown, fuel is injected into the cylinders of the engine using a fuel injector assembly 120. Each cylinder of the internal combustion engine can have a separate fuel injector 130.

The cylinder head 70 is fitted onto the engine block 140. The cylinder head and the engine block are provided with channels for cooling.

Figure 4:
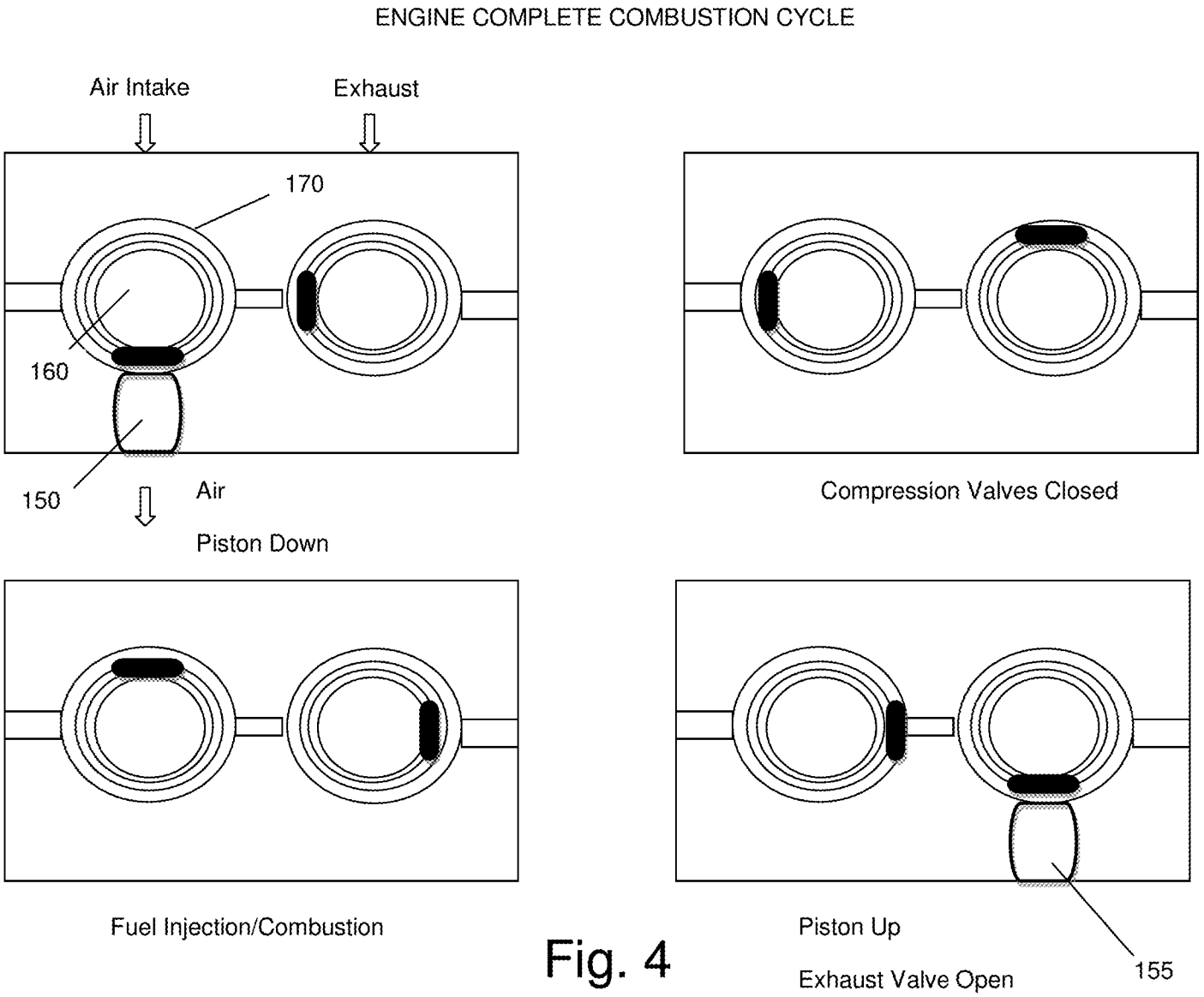
FIG. 4 shows an engine combustion cycle of an embodiment of the present invention.

The four stroke combustion cycle is shown in FIG. 4. During the air intake stroke, the air intake valve 150 is open by having egress to the corresponding hole in the roller valve 10. It should be noted that the outer insulator 40 has the most contact with the cylinder 160 and to the oiling jacket 170. Lubrication is provided by positive pressure from the outer insulator 40 to the roller valve 10 and to the inner insulator 80.

As the roller valve continues to rotate, the valves remain shut during both the compression stroke and the power stroke, although the holes in the two roller valves are offset. The exhaust valve 155 is open during the exhaust stroke.

Figure 5:
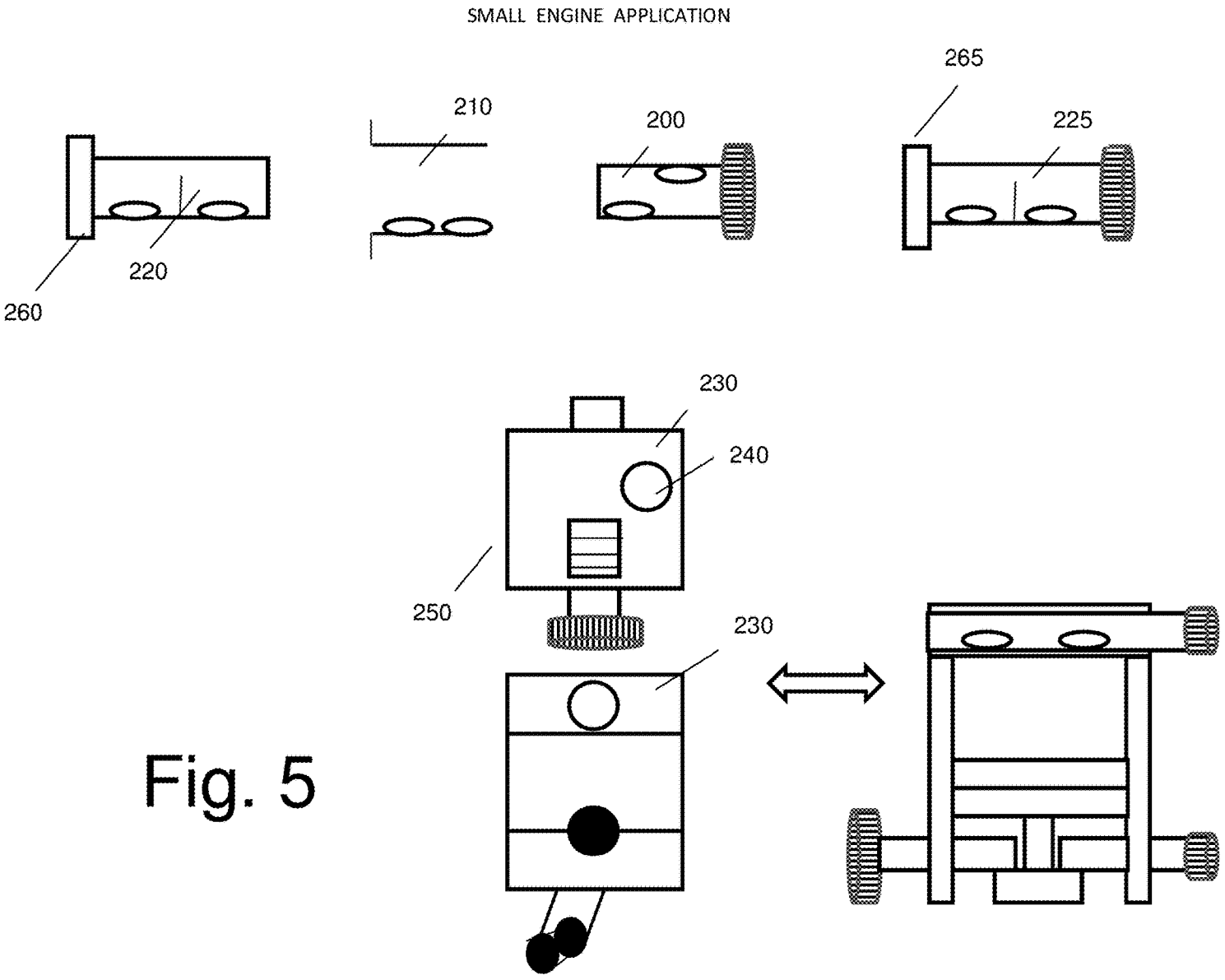
FIG. 5 shows a small engine application of an embodiment of the present invention.

FIG. 5 shows a non-limiting small-engine application of the invention. The hollow tube roller valve 200 is surrounded by an outer insulator 210, also called a lubricator. The roller valve 200 encases an inner insulator 220. The roller valve 200, the outer insulator 210, and the inner insulator 220 form a valve assembly 225. The engine head 230 includes a fuel injection port 240 and a spark plug port 250. An insulator end cap 260 insulates the bulkhead 265. The bulkhead 265 separates the exhaust, and air drawn into the engine is separated by the bulkhead 265 to the exhaust outlet.

The clearances between the roller valve 10, 200 the outer insulator 40, 210 and the inner insulator 80, 220 should be sufficient for adequate lubrication without resulting in excessive oil flow. The clearances approximate those for bearings, and ranges between 0.001 inches and 0.003 inches (clearances less than 0.001 inches provide insufficient oil flow, while the oil flow is two high with clearances over 0.003 inches). Preferred clearances are 0.0017 inches, 0.0018 inches and 0.002 inches.

Performance can be improved by placing bearings between the roller valve 10, 200 and the outer insulator 80, 210 and/or between the roller valve 10, 200 and the inner insulator 80, 220.

Figure 6:
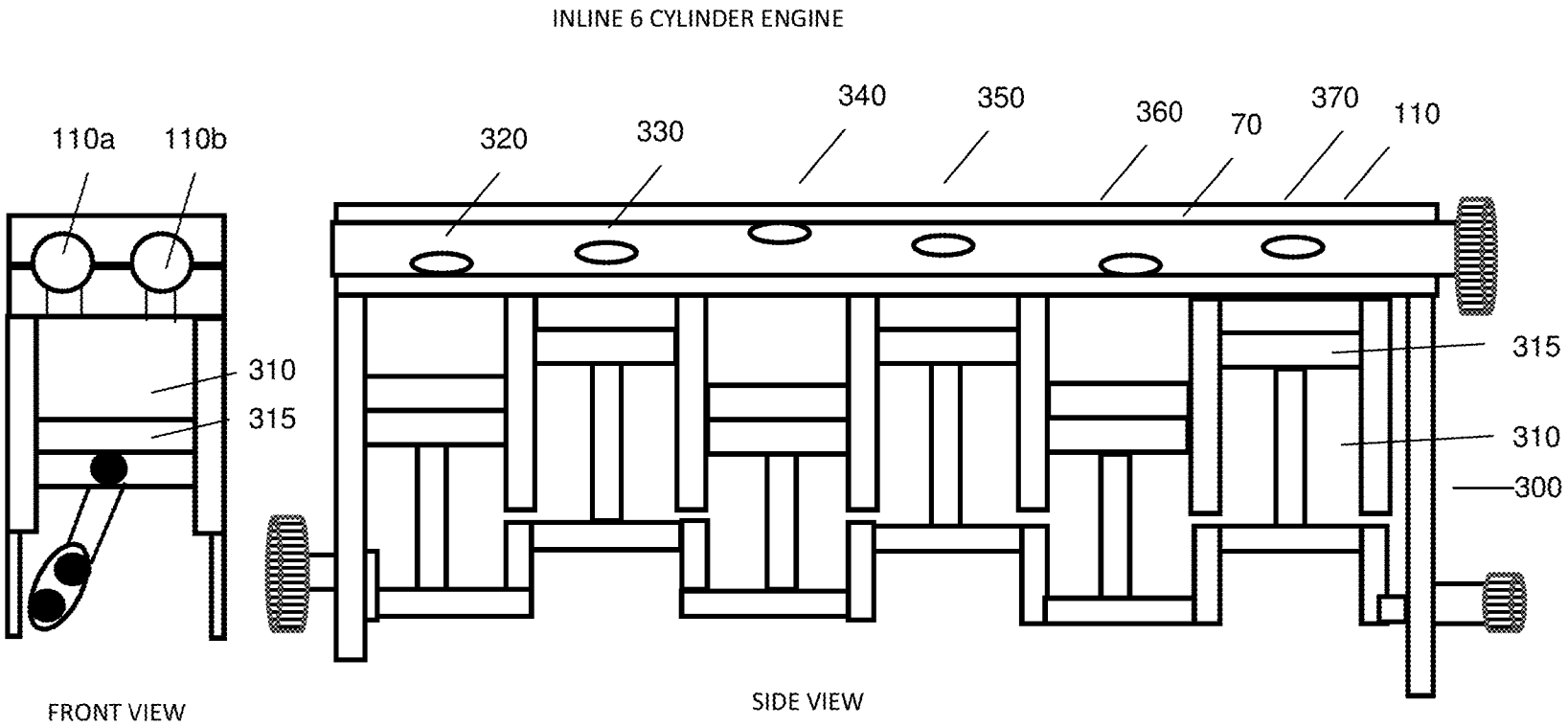
FIG. 6 shows a front and side view of a six cylinder engine according to an embodiment of the present invention.

FIG. 6 shows an embodiment of the present invention for a six cylinder engine 300. The roller valve 10, the outer insulator 40 and the inner insulator 80 form a valve assembly 110. Two valve assemblies 110 can be mounted to the cylinder head 70. In this embodiment, one valve assembly 110*a* is used for air intake and the other valve assembly 110*b* is used for exhaust.

The six cylinder engine 300 has cylinders 310 with pistons 315 arranged as shown in FIG. 6. At a first position 320 valve assembly 110*a* inlets air. At a second position 330, compression occurs with both valve assemblies 110*a* and 110*b* being closed. At a third position 340, combustion occurs with both valve assemblies 110*a* and 110*b* being closed. At a fourth position 350, the cylinder is exhausted through exhaust valve 110*b*. At a fifth position 360, air is inlet again for a further compression at position 370.

Material selection is an aspect which should be considered. For example, at an average rotational speed of 3,600 revolutions per minute, the valves of a gasoline engine open and close 30 times a second. Intake valves run cooler and are washed with fuel vapors which tend to rinse away lubrication. So for intake valves, wear resistance may be more important than high temperature strength or corrosion resistance if the engine is intended to be utilized with any kind of endurance.

Exhaust valves, on the other hand, run much hotter than intake valves and must withstand the corrosive effects of hot exhaust gases and the weakening effects of high temperatures.

Consequently, a premium valve material is an absolute requirement on the exhaust side. As combustion temperatures go up, valve alloys that perform adequately in an engine may not have the strength, wear or corrosion resistance to hold up.

Steel alloys with a martensitic grain structure typically have a high hardness at room temperature (35 to 55 Rockwell C) after tempering, which improves strength and wear resistance. These characteristics make this type of steel a good choice for applications such as engine valves.

But as the temperature goes up, martensitic steel loses hardness and strength. Above 1,000 degrees F. or so, low carbon alloy martensitic steel loses too much hardness and strength to hold up very well. For this reason, low carbon alloy martensitic steel is only used for intake valves, not exhaust valves. Intake valves are cooled by the incoming air/fuel mixture and typically run around 800 degrees to 1,000 degrees F., while exhaust valves are constantly blasted by hot exhaust gases and usually operate at 1,200 degrees to 1450 degrees F. or higher.

To increase high temperature strength and corrosion resistance, various elements may be added to the steel. On some passenger car and light truck engines, the original equipment intake valves are 1541 carbon steel with manganese added to improve corrosion resistance. For higher heat applications, a 8440 alloy may be used that contains chromium to add high temperature strength.

For many engines (and performance engines), the intake valves are made of an alloy called "Silchrome 1" (Sil 1) that contains 8.5 percent chromium.

Exhaust valves may be made from a martensitic steel with chrome and silicon alloys, or a two-piece valve with a stainless steel head and martensitic steel stem. On applications that have higher heat requirements, a stainless martensitic alloy may be used. Stainless steel alloys, as a rule, contain 10 percent or more chromium.

The most popular materials for exhaust valves, however, are austenitic stainless steel alloys such as 21-2N and 21-4N. Austenite forms when steel is heated above a certain temperature which varies depending on the alloy. For many steels, the austenitizing temperature ranges from 1,600 degrees to 1675 degrees F., which is about the temperature where hot steel goes from red to nearly white). The carbon in the steel essentially dissolves and coexists with the iron in a special state where the crystals have a face-centered cubic structure.

By adding other trace metals to the alloy such as nitrogen, nickel and manganese, the austenite can be maintained as the metal cools to create a steel that has high strength properties at elevated temperatures. Nitrogen also combines with carbon to form carbo nitrides that add strength and hardness. Chromium is added to increase corrosion resistance. The end product is an alloy that may not be as hard at room temperature as a martensitic steel, but is much stronger at the high temperatures at which exhaust valves commonly operate.

21-2N alloy has been around since the 1950s and is an austenitic stainless steel with 21 percent chromium and 2 percent nickel. It holds up well in stock exhaust valve applications and costs less than 21-4N because it contains less nickel. 21-4N is also an austenitic stainless steel with the same chromium content but contains almost twice as much nickel (3.75 percent), making it a more expensive alloy. 21-4N is usually considered to be the premium material for performance exhaust valves. 21-4N steel also meets the "EV8" Society of Automotive Engineers (SAE) specification for exhaust valves.

SAE classifies valve alloys with a code system: "NV" is the prefix code for a low-alloy intake valve, "HNV" is a high alloy intake valve material, "EV" is an austenitic exhaust valve alloy, and "HEV" is a high-strength exhaust valve alloy.

Titanium can also as an insert around the holes in the roller valves of the present invention. Titanium valves are often coated with molybdenum, chromium or another friction-reducing surface treatment. However, a wide range of materials can be used for coating the roller valve or the brake. These include (sorted by coefficient of thermal expansion$\times 10^{-6}$ in/(in*° F.): tungsten (2.5), molybdenum (2.7), chromium (2.7), zirconium (3.2), rhenium (3.4), tantalum (3.6), iridium (3.6), ruthenium (3.6), rhodium (4.6) vanadium (4.7) and titanium (4.8).

As discussed above, one particular embodiment of the present invention provides a compression release engine brake (also known as a "Jake Brake") typically for use in a diesel engine. The principle of a compression release engine brake is to regulate the exhaust valves so that gases under pressure within the cylinder are caused to be evacuated when the operator intends to slow the vehicle. Compression release braking is typically associated with diesel engines because, unlike throttle-based gasoline engines, diesel engines typically do not throttle intake air when the operator slows down the engine, resulting in an excess of gas pressure in the cylinders. Even though the operator has reduced or eliminated flow of fuel into the engine, the un-throttled air drawn into the engine causes a spring effect upon the pistons in the power stroke, so that the engine slows more gradually and does not contribute as much to slowing the vehicle.

The conventional compression release engine brake uses an add-on hydraulic system, actuated with engine oil. When activated, the motion of the fuel injector rocker arm is transferred to the engine exhaust valve(s). This occurs very near the top dead center position of the piston and releases the compressed air in the cylinder so that that the compressed air is not available to push against the piston head during the power stroke and thereby energy is not returned to the crankshaft. Energy from the gases in the cylinder is instead released to the surroundings, and the engine becomes an excellent "brake" working against the momentum of the transmission. When used properly, this energy can be used by a truck driver to maintain speed or even slow the vehicle with little or no use of the friction brakes against the wheels. The power of this type can be around the same as the engine power.

The use of conventional compression release engine brakes, however, often cause a vehicle to make a loud chattering or "machine gun like" exhaust noise, especially vehicles having high flow mufflers, or no mufflers at all, causing many communities in the United States, Canada and Australia to prohibit compression braking within municipal limits. Drivers are notified by roadside signs with legends such as "Brake Retarders Prohibited," "Engine Braking Restricted," "Jake Brakes Prohibited," "No Jake Brakes," "Compression Braking Prohibited," "Limit Compression Braking," "Avoid Using Engine Brakes," or "Unmuffled Compression Braking Prohibited," and enforcement is typically through traffic fines. Such prohibitions have led to the development of new types of mufflers and turbochargers to better silence compression braking noise.

These disadvantages are minimized by utilizing roller valves according to the present invention, because the elimination of tappet valves reduces the chatter and clatter associated with conventional compression release brakes.

Figure 7:
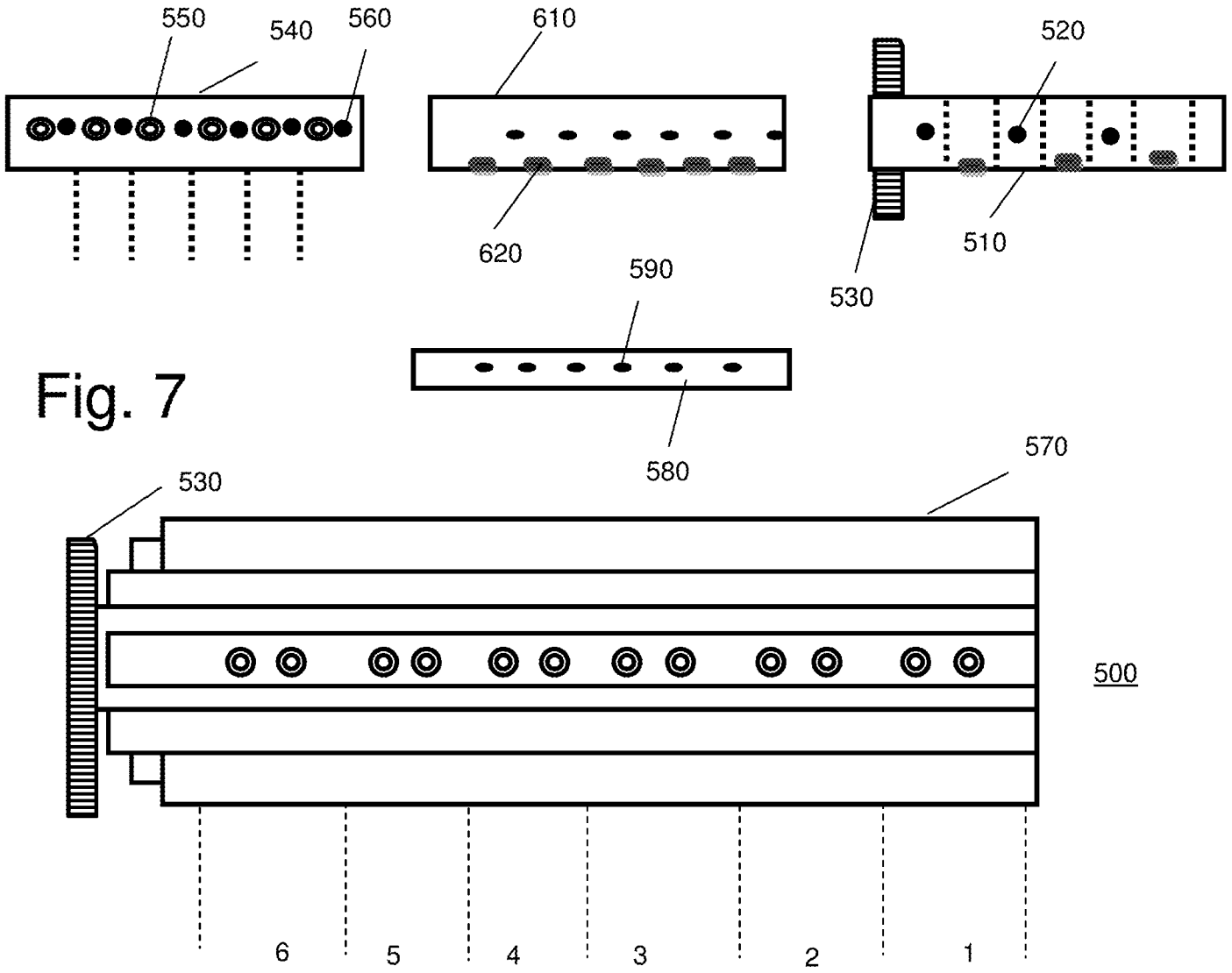
FIG. 7 shows a valve assembly that includes a compression release engine brake according to an embodiment of the present invention.

FIG. 7 shows a valve assembly 500 that includes a compression release engine brake in accordance with a particular embodiment of the invention. Similar to the previously describe roller valve, the valve assembly includes a roller valve 510, a hollow cylinder which is a plurality of holes 520, generally one per cylinder of the internal combustion engine. A timing gear 530 is attached to one end of the roller valve for driving the roller valve in rotation. Surrounding the roller valve 510 is an outer insulator 540, which is a hollow tube with a diameter greater than the roller valve 510, and has openings 550 that correspond to each cylinder of the internal combustion engine. At least one lubrication port 560 is associated with each opening 550 of the outer insulator 540. The outer insulator 540 is fixed in the cylinder head 570.

Inside the roller valve 510 is an inner insulator 580. The inner insulator 580 is a hollow tube with an outer diameter which is smaller than the inner diameter of the roller valve 510. The inner insulator has holes or ports 590 which correspond to the holes in the roller valve. The inside insulator does not have lubricating ports, just exhaust and engine brake ports.

The compression release brake incudes a hollow brake tube 610 that is located between the roller valve 510 and the outer insulator 540. The hollow engine brake tube 610 has ports 620.

To activate engine braking, the brake tube is caused to pivot about its central axis to an open port, and through the spinning louvers set in the exhaust valve tube and out the back of the exhaust valve.

The engine brake tube 610 can activate in three stages. For each stage there is a ¼ pivot from the off position, ¼ more post are set in position to activate more cylinders to engine brake.

Hybrid engine braking is activated in one and two stages. The remaining cylinders that are not activated sustain trapped air as a result of the engine brake tube pivot to one or two stages. The engine brake tube cuts off exhaust flow out of the residual cylinders, trapping the air. As a result, the air is compressed, applying a resistance to the crank shaft, assisting engine braking with the exhaust engine braking. The hybrid braking thus utilizes exhaust and air compression.

Activation of the engine brake requires electromagnetic contact solenoids fastened to the timing gear, and a pressure plate fastened to the engine brake tube end. The solenoid clutch times to the engine brake tube, the tube pivots to the desired position by the drives. The brake tube is stopped by a position cleat solenoid, one for each stage, and simultaneously cuts off the engine brake clutch solenoid.

Figure 8:
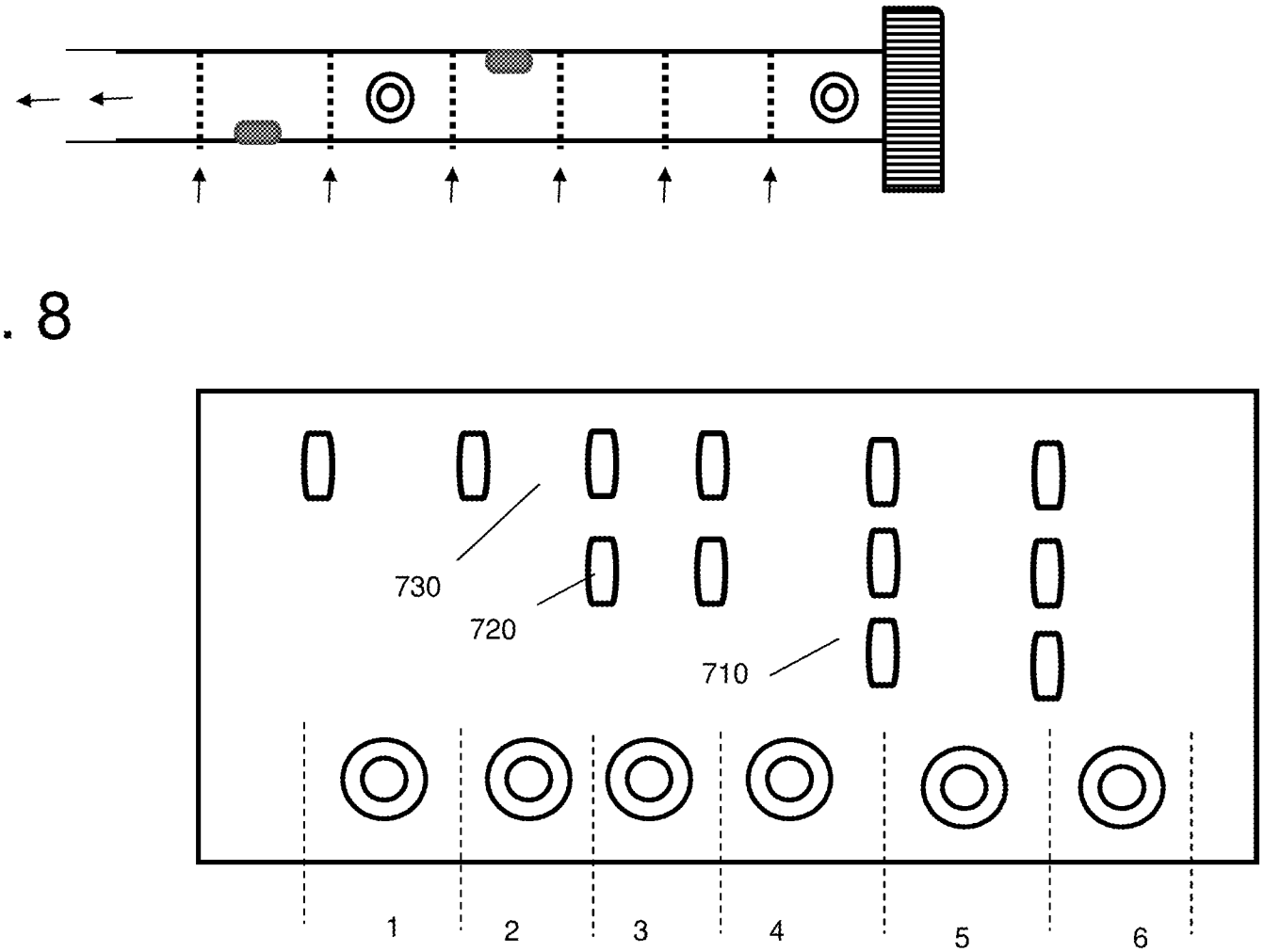
FIG. 8 shows a valve and a compression release brake system for a six cylinder diesel engine according to an embodiment of the present invention.

FIG. 8 shows a valve and brake system for a six cylinder diesel engine. As can be seen, the hollow tubular brake can have two openings 710 in line for two cylinder braking, four openings 720 in line for four cylinder breaking, or six cylinders 730 in line for six cylinder braking. The openings can be staggered, for example, for braking at cylinders 2 and 6, as shown. However, all iterations can be used, for example, holes for cylinders 1/2, 1/3, 1/4 1/5/, 1/6, 1/2/6. 1/3/6, 1/4/6, 1/5/6, 1/2/5, 1/3/5, 1/4/5, etc.

Figure 9:
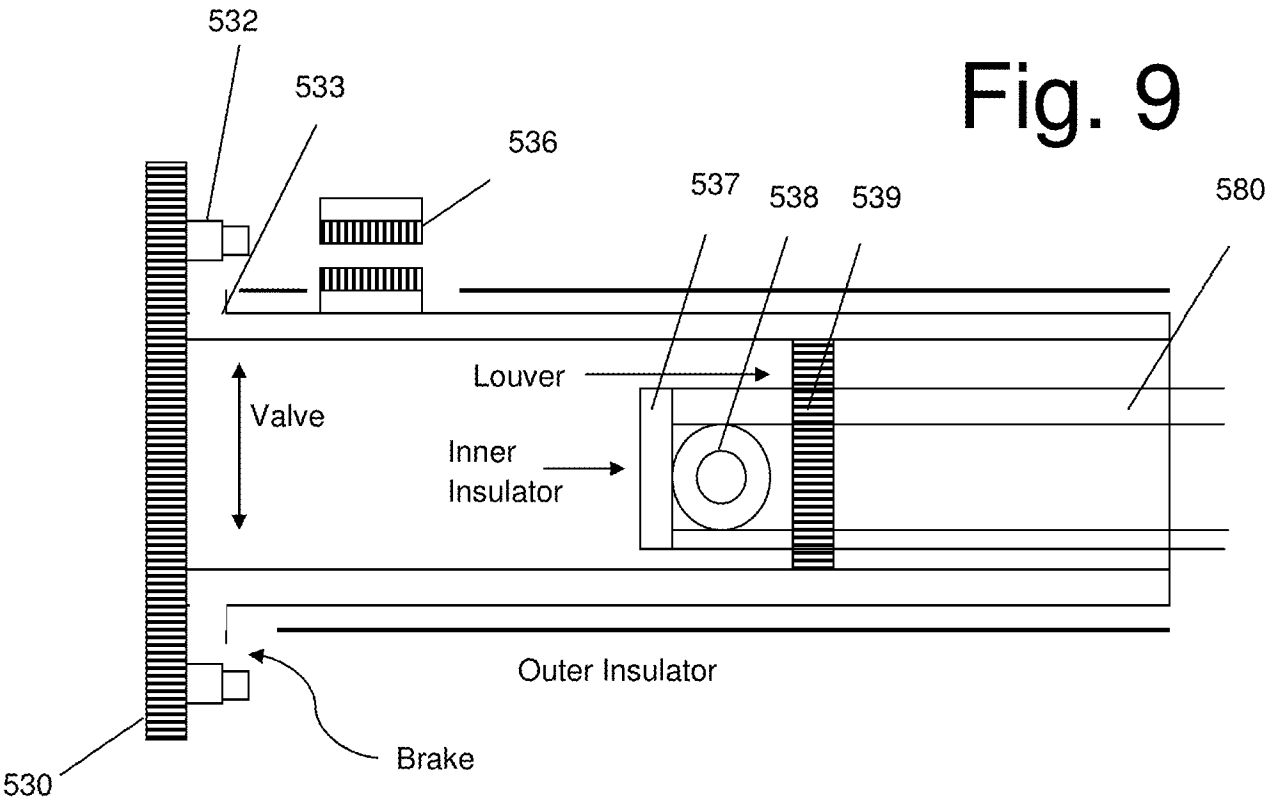
FIG. 9 shows details of a compression release engine brake according to an embodiment of the present invention.

As shown in FIG. 9, the brake system includes a timing gear 530, an engine brake clutch solenoid 532, an engine brake pressure plate 533 and engine brake 534 position cleats 536. The brake clutch solenoid can be activated by a switch on the dash of the motor vehicle (not shown). Various levels of braking can be selected. A "Low" setting provides approximately one-third of the total braking horsepower. When the "Medium" setting is selected, approximately two-thirds braking horsepower will be applied. The "High" setting provides a configuration that applies full braking horsepower. Other configurations besides the dash switch may be offered to give control of the on/off function of the engine brake. Options may include a foot-operated pedal, a steering wheel mount, or a shift lever switch.

The position cleats 536 correspond to each of the braking configurations. For example, if there are 6 configurations, one corresponding to a single or multiple louvers being open to a corresponding cylinder or grouping of cylinders, there can be six position cleats. However, there is no restriction to the number of position cleats, which can be any number of from one to six or greater. The inner insulator 580 terminates in a bridge 537 housing a primary exhaust 538 and an engine brake louvre 539.

Figure 10:
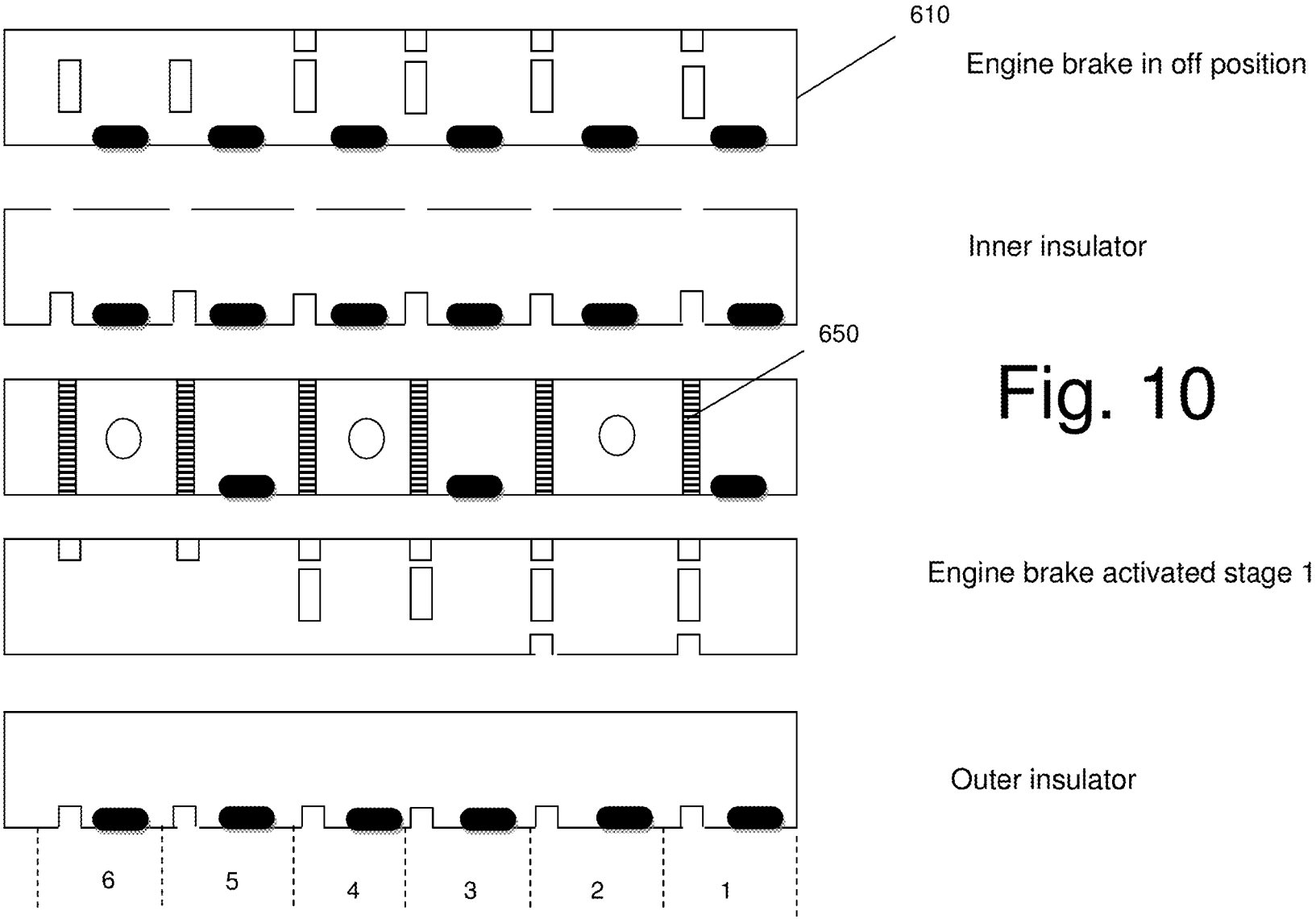
FIG. 10 shows operating positions of a compression release engine brake according to an embodiment of the present invention.

As shown in FIG. 7, the hollow brake tube 610 is located between the roller valve 610 and the outer insulator 540 with an intervening brake exhaust cover 640. During operation, the exhaust brake is open to the cylinder. When not in operation, the exhaust is closed. The position clutch cleats located on the brake enable the solenoid to rotate the brake between several positions. The first position is the off position. The solenoid 532 is used to rotate the brake to the various braking positions (for different combinations of cylinders) shown in FIG. 8. Please note that the engine brake exhaust louvers 650 are set tandem to the main exhaust, as is shown in FIG. 10.

Figure 11:
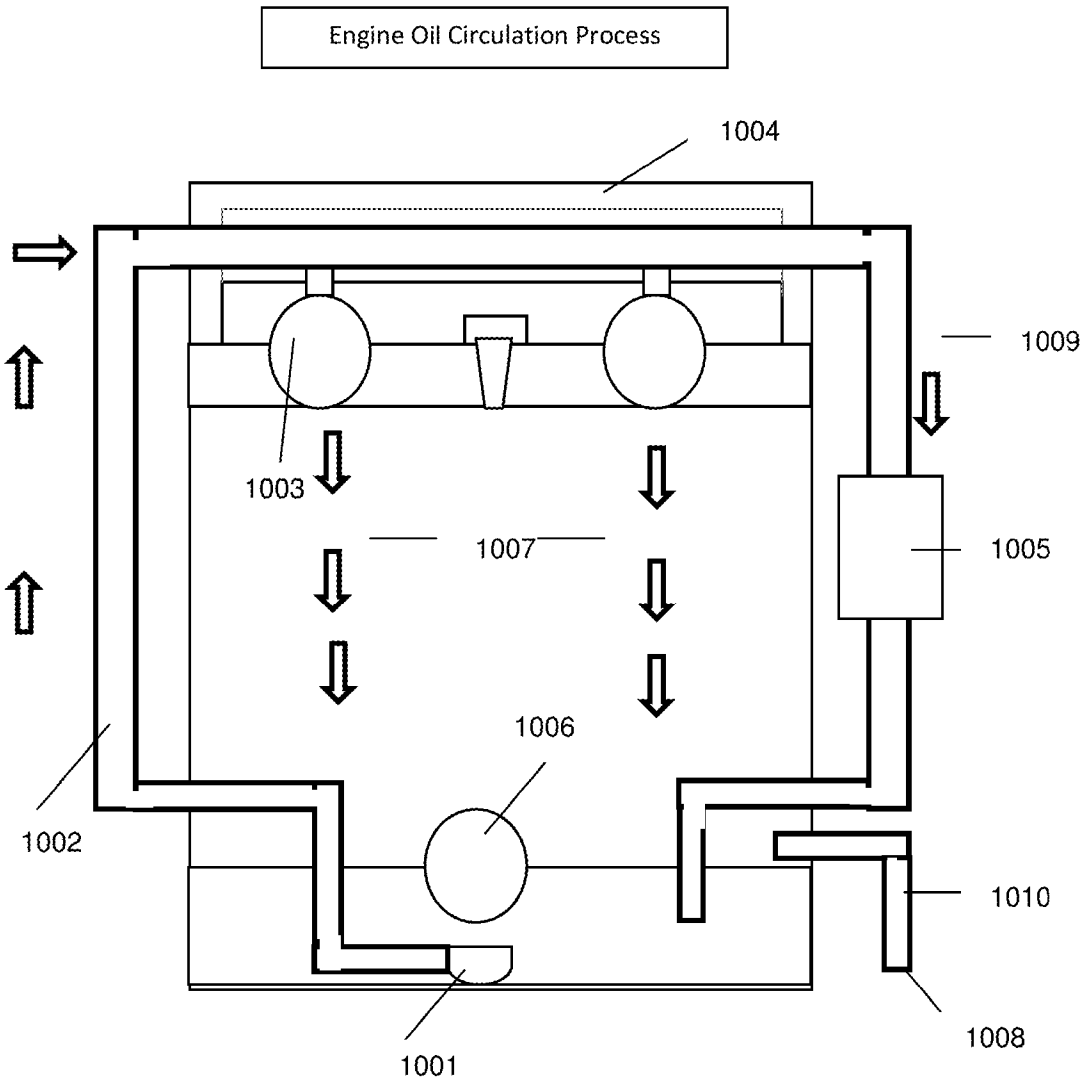
FIG. 11 shows engine oil recirculation.

The engine oil recirculation is shown in FIG. 11. The oil recirculation system includes an oil pump 1001 to help achieve complete oil recirculation 1002 via oil supply valves 1003 protected by a valve cover 1004. An oil pressure regulator 1005 has access to the crank shaft 1006. A oil drain valve 1007 is housed in an oil pan 1008. The engine head 1009 is fitted with an engine blow-by tube 1010.

Figure 12:
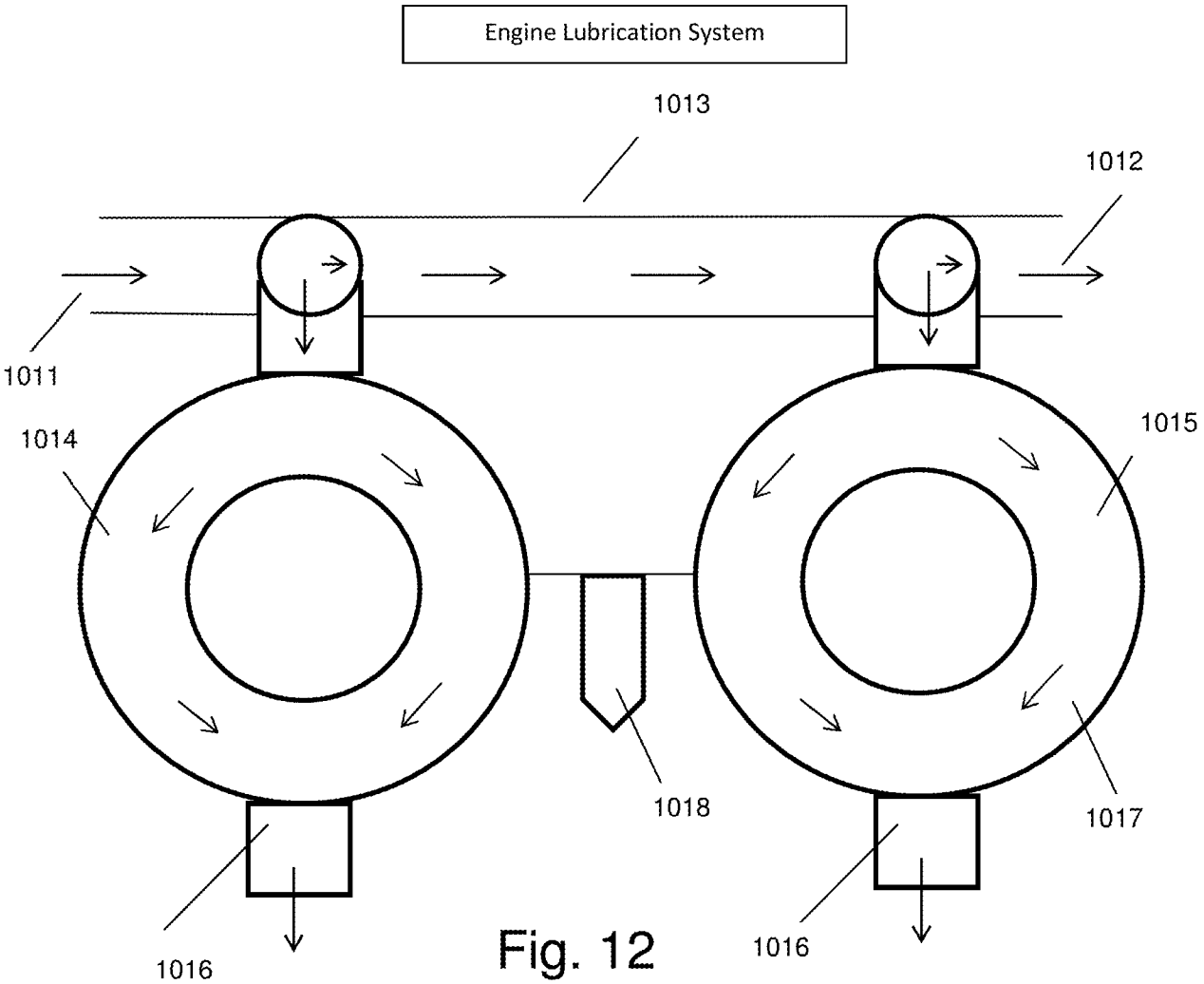
FIG. 12 shows lubrication with oil supply ports.

As is shown in FIG. 12, the lubrication system includes a central oil supply port 1011 and an oil supply return port 1012 of an oil supply tube 1013, which are connected to an oil intake tubular valve 1014 and an exhaust tubular valve 1015. Oil drain ports 1016 enable lubricant channeling back to the crankcase 1017. The system includes fuel injector 1018. As is shown in FIG. 12, the oil feed is through the top of the valve tubes and drains out the bottom.

Figure 13:
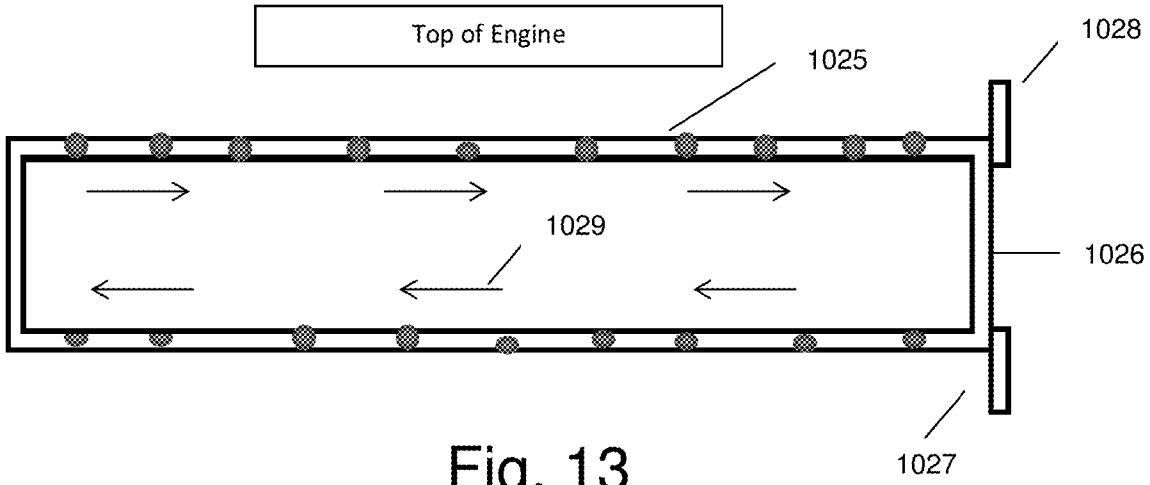
FIG. 13 shows engine lubrication at the top of the engine.
Figure 13:
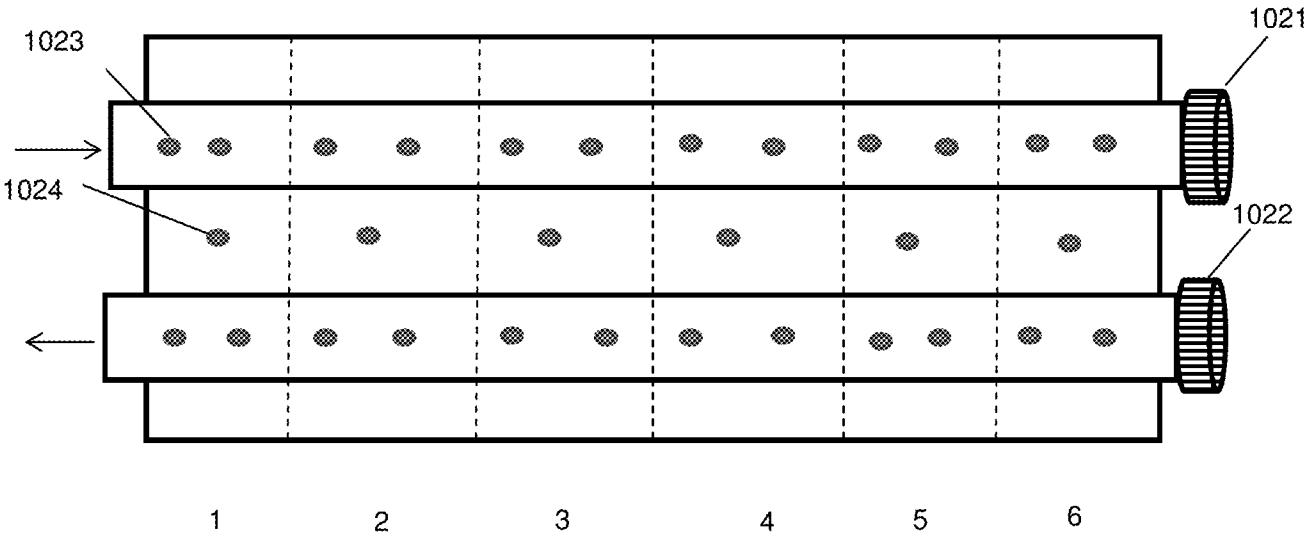

FIG. 13 shows the lubrication at the top of the engine. The lubrication scheme includes an air intake tubular valve 1021, and exhaust tubular valve 1022, oil supply ports 1023, fuel injector ports 1024, an oil supply tube 1025, a bridge connector 1026, an oil supply entry 1027, an oil return port 1028 to achieve an oil supply circuit 1029 in the tube.

Figure 14:
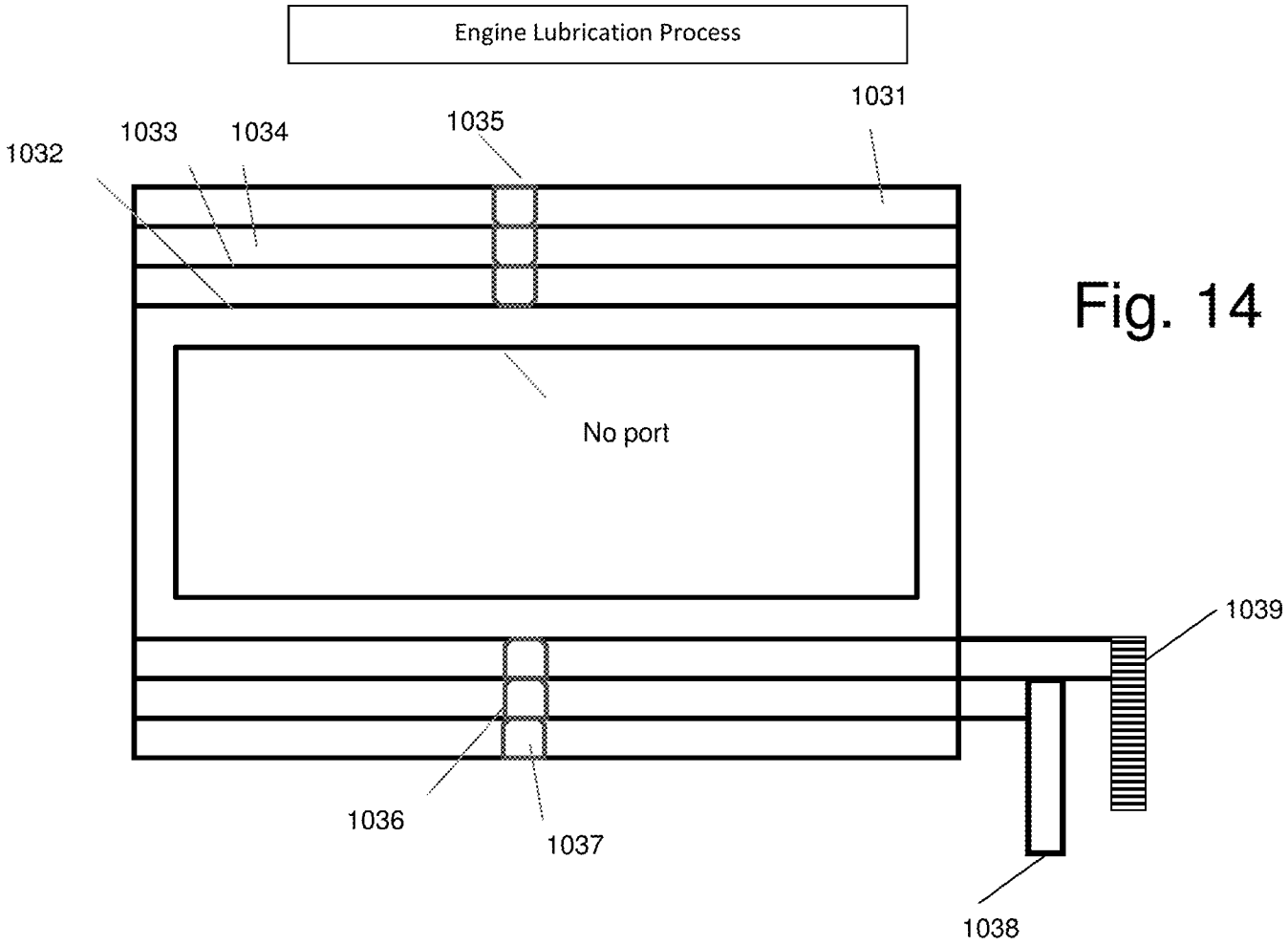
FIG. 14 shows the engine lubrication process for the engine brake.

FIG. 14 shows the engine lubrication process for the engine brake 1032, which includes an outer insulator 1031, engine valve 1033, inner insulator 1034, oil supply port 1035, oil jacket ports 1036, an oil drain port 1037, an engine brake pressure plate 1038 and a timing gear 1039.

The present invention yields numerous advantages. The tubular valve and brake system requires fewer parts than a conventional poppet valve system. There are thus fewer costs for assembly and maintenance. Also the engine brake is a simple insert to the tube brake, and the elaborate machinery required by a conventional "Jake Brake" is not necessary. It is also expected that there will be substantial reductions of noise as compared to the conventional engine braking systems.

It is to be understood that the foregoing descriptions and specific embodiments shown herein are merely illustrative of the best mode of the invention and the principles thereof, and that modifications and additions may be easily made by those skilled in the art without departing for the spirit and scope of the invention, which is therefore understood to be limited only by the scope of the appended claims.

INDEX OF REFERENCE NUMERALS

10—roller valve
20—ports or holes
30—timing gear
40—outer insulator
50—openings corresponding to each cylinder
60—lubrication port
70—cylinder head
80—inner insulator
90—ports or holes of the inner insulator
110—valve assembly
110*a*—air intake valve assembly
110*b*—exhaust valve assembly
120—fuel injector assembly
130—fuel injector
140—engine block
150—air intake valve
160—cylinder
170—oiling jacket
200—hollow tube roller valve
210—outer insulator
220—inner insulator
225—valve assembly
230—engine head
240—fuel injection port
150—spark plug port
260—insulator end cap
265—bulkhead
300—six cylinder engine
310—six cylinders
320—first position (inlet)
330—second position (compression)
340—third position (combustion)
350—forth position (exhaust)
360—fifth position (air inlet)
370—sixth position (further compression)
500—compression brake valve assembly
510—roller valve
520—holes or ports
530—timing gear
532—clutch solenoid
533—engine brake pressure plate
534—engine brake
536—position cleats
537—bridge
538—primary exhaust
539—engine brake louvre
540—outer insulator
550—openings
560—lubrication port
570—cylinder head
580—inner insulator
590—holes or ports
610—hollow brake tube
620—holes or ports of the hollow brake tube
640—exhaust cover
650—exhaust louvres
710—two openings
720—four openings
730—six cylinders
1001—oil pump
1002—oil recirculation
1003—oil supply valves

1004—valve cover
1005—oil pressure regulator
1006—crank shaft
1007—oil drain valve
1008—oil pan
1009—engine head
1010—engine blow-by tube
1011—central oil supply port
1012—oil return supply port
1013—oil supply tube
1014—oil intake tubular valve
1015—exhaust tubular valve
1016—oil drain ports
1018—fuel injector
1021—air intake tubular valve
1022—exhaust tubular valve
1023—oil supply ports
1024—fuel injector supply ports
1025—oil supply tube
1026—bridge connector
1027—oil supply entry
1028—oil return port
1029—oil supply circuit
1031—outer insulator
1032—engine brake
1033—engine valve
1034—inner insulator
1035—oil supply port
1036—oil jacket ports
1037—oil drain port
1038—engine back pressure plate
1039—timing gear
C—crankshaft
E—exhaust camshaft
I—inlet camshaft
P—piston
R—connecting rod
S—spark plug
V—inlet and exhaust valves
W—cooling water

What is claimed is:

1. A valve for an internal combustion engine, comprising:
a completely hollow tube;
at least one port in the hollow tube, the at least one port being configured to access an air inlet or an exhaust of a cylinder in an engine block;
a completely hollow tubular outer insulator outside of the hollow tube, the outer insulator being fixed to a cylinder head; and
a completely hollow tubular inner insulator inside of the hollow tube,
wherein the valve is configured such that air or exhaust passes through a length of the hollow tubular inner insulator parallel to a wall of the hollow tubular inner insulator.

2. The valve according to claim 1, wherein the outer insulator has a port corresponding to each cylinder in the engine block.

3. The valve according to claim 1, wherein the inner insulator has a port corresponding to each cylinder in the engine block.

4. The valve according to claim 1, wherein the outer insulator has a port corresponding to each cylinder in the engine block, and each port in the outer insulator is associated with a lubrication port.

5. The valve according to claim 1, further comprising a gear at one end of the outer tube.

6. The valve according to claim 1, wherein a clearance between the hollow tube and each of the outer insulator and the inner insulator is between 0.001 inches and 0.003 inches.

7. A valve system for an internal combustion engine, comprising:
first and second valves according to claim 1, wherein
the first valve is an air inlet valve, and
the second valve is an exhaust valve.

8. The valve system according to claim 7, wherein the inlet valve is formed from carbon alloy martensitic steel.

9. The valve system according to claim 7, wherein the exhaust valve is formed from austenitic stainless steel alloy.

10. An exhaust valve and engine brake for a four stroke internal combustion engine, comprising:
a completely hollow tube;
at least one port in the completely hollow tube, the at least one port being configured to access an air inlet or an exhaust of a cylinder in an engine block;
a tubular outer insulator outside of the completely hollow tube, the outer insulator being fixed to a cylinder head;
a tubular inner insulator inside of the hollow tube; and
a tubular brake between the completely hollow tube and the outer insulator, the tubular brake having several combinations of louvers configured for engine brake a corresponding combination of engine cylinders,
wherein the valve is configured such that air or exhaust passes through a length of the hollow tubular inner insulator parallel to a wall of the hollow tubular inner insulator.

11. The exhaust valve and engine brake according to claim 10, further comprising a timing gear connected to the completely hollow tube.

12. The exhaust valve and engine brake according to claim 10, further comprising a brake clutch configured to rotate the tubular brake, and a solenoid activating the brake clutch.

13. The exhaust valve and engine brake according to claim 10, further comprising and engine brake pressure plate.

14. The exhaust valve and engine brake according to claim 10, further comprising position cleats connected to the tubular brake.

15. An internal combustion engine comprising the valve according to claim 1, wherein the internal combustion engine has no camshaft and no pushrods.

16. An internal combustion engine comprising the exhaust valve and engine brake according to claim 10, wherein the internal combustion engine has no camshaft and no pushrods.

17. An internal combustion engine, comprising:
an engine block;
two or more cylinders in the engine block;
a cylinder head on the engine block;
a tubular air valve and a tubular exhaust valve running through a length of the cylinder head, each of the tubular air valve and the tubular exhaust valve comprising:
a completely hollow tube;
at least one port in the hollow tube, the at least one port being configured to access an air inlet or an exhaust of a cylinder in an engine block;
a completely hollow tubular outer insulator outside of the hollow tube, the outer insulator being fixed to a cylinder head; and
a completely hollow tubular inner insulator inside of the hollow tube, wherein the valve is configured such that air or exhaust passes through a length of the hollow tubular inner insulator parallel to a wall of the hollow tubular inner insulator, and wherein the internal combustion engine has no camshaft and no pushrods.

18. The internal combustion engine according to claim 17, wherein lubrication is provided by positive pressure from the outer insulator to the inner insulator.

19. The valve according to claim 1, wherein lubrication is provided by positive pressure from the outer insulator to the inner insulator.

20. The exhaust valve and engine brake according to claim 10, wherein lubrication is provided by positive pressure from the outer insulator to the inner insulator.

* * * * *